US009322219B2

(12) United States Patent
Burhan et al.

(10) Patent No.: US 9,322,219 B2
(45) Date of Patent: Apr. 26, 2016

(54) ROLLING CUTTER USING PIN, BALL OR EXTRUSION ON THE BIT BODY AS ATTACHMENT METHODS

(71) Applicant: SMITH INTERNATIONAL, INC., Houston, TX (US)

(72) Inventors: Yuri Burhan, Spring, TX (US); Youhe Zhang, Spring, TX (US); Yuelin Shen, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 312 days.

(21) Appl. No.: 13/706,153

(22) Filed: Dec. 5, 2012

(65) Prior Publication Data

US 2013/0140094 A1 Jun. 6, 2013

Related U.S. Application Data

(60) Provisional application No. 61/566,875, filed on Dec. 5, 2011.

(51) Int. Cl.

| | |
|---|---|
| ***E21B 10/43*** | (2006.01) |
| ***E21B 10/46*** | (2006.01) |
| ***E21B 10/573*** | (2006.01) |

(52) U.S. Cl.

CPC ..... *E21B 10/43* (2013.01); *E21B 10/46* (2013.01); *E21B 10/573* (2013.01)

(58) Field of Classification Search

CPC ..... E21B 10/43; E21B 10/50; E21B 10/52; E21B 10/55; E21B 10/573; E21B 10/627; E21B 10/633; E21B 10/08

See application file for complete search history.

(56) References Cited

U.S. PATENT DOCUMENTS 3,271,080 A * 9/1966 Gowanlock ..... 299/103
4,553,615 A * 11/1985 Grainger ..... 175/432

(Continued)

FOREIGN PATENT DOCUMENTS

AU 2012249669 A3 11/2013
CA 2744144 A1 11/2007

(Continued)

OTHER PUBLICATIONS

Zhang, et. al., "Polycrystalline Diamond Compact Cutters With Conic Shaped End", South Africa Patent Application No. 2013/07838 filed Apr. 26, 2012; 37 pages.

(Continued)

*Primary Examiner* — Cathleen Hutchins

(57) ABSTRACT

A drill bit has a bit body, a plurality of blades extending radially from the bit body, wherein each blade comprises a leading face and a trailing face, a plurality of cutter pockets disposed on the plurality of blades, at least one rolling cutter, wherein each rolling cutter is disposed in one of the cutter pockets, and wherein each rolling cutter comprises a cutting face, a cutting edge, an outer circumferential surface, and a back face. A back retainer is disposed adjacent to the back face, wherein the back retainer protrudes partially into the rolling cutter along a rotational axis of the rolling cutter, and a front retainer is disposed adjacent to the at least one rolling cutter on the leading face of the blade. Each front retainer has a retention end, wherein the retention end is positioned adjacent to a portion of the cutting face of each rolling cutter, and an attachment end, wherein the attachment end is attached to a portion of the blade.

27 Claims, 20 Drawing Sheets

(56) References Cited

U.S. PATENT DOCUMENTS

| | | | | |
|---|---|---|---|---|
| 5,737,980 | A | 4/1998 | Keith et al. | |
| 5,975,811 | A * | 11/1999 | Briese | 407/40 |
| 7,703,559 | B2 | 4/2010 | Shen et al. | |
| 8,091,655 | B2 | 1/2012 | Shen et al. | |
| 8,413,746 | B2 | 4/2013 | Shen et al. | |
| 2007/0278017 | A1 * | 12/2007 | Shen et al. | 175/426 |
| 2011/0284293 | A1 | 11/2011 | Shen et al. | |
| 2011/0297454 | A1 * | 12/2011 | Shen | E21B 10/633 175/431 |
| 2012/0273280 | A1 | 11/2012 | Zhang et al. | |
| 2012/0273281 | A1 | 11/2012 | Burhan et al. | |
| 2013/0220707 | A1 | 8/2013 | Shen et al. | |

FOREIGN PATENT DOCUMENTS

| | | | |
|---|---|---|---|
| CA | 2590282 | C | 3/2012 |
| CA | 2834357 | A1 | 11/2012 |
| CN | 103492661 | A | 1/2014 |
| CN | 103635654 | A | 3/2014 |
| GB | 2445432 | B | 7/2010 |
| GB | 2446984 | B | 7/2010 |
| GB | 2461396 | B | 7/2010 |
| GB | 2493322 | A | 1/2013 |
| MX | 2013012476 | A1 | 1/2014 |
| WO | 2011146736 | A2 | 11/2011 |
| WO | 2011153439 | A1 | 12/2011 |
| WO | 2012149086 | A2 | 11/2012 |
| WO | 2012149120 | A2 | 11/2012 |

OTHER PUBLICATIONS

Burhan, et al., "Methods of Attaching Rolling Cutters in Fixed Cutter Bits Using Sleeve, Compression Spring, and/or Pin(S)/Ball(S)", Brazil Patent Application No. 112013027545.6 filed Apr. 26, 2012; 43 pages.

Burhan, et al., "Methods of Attaching Rolling Cutters in Fixed Cutter Bits Using Sleeve, Compression Spring, and/or Pin(S)/Ball(S)", Oman Patent Application No. OM/P/2013/00259 filed Apr. 26, 2012; 43 pages.

* cited by examiner

ROLLING CUTTER USING PIN, BALL OR EXTRUSION ON THE BIT BODY AS ATTACHMENT METHODS

CROSS-REFERENCE TO RELATED APPLICATION

This application claims the benefit of U.S. Provisional Patent Application Ser. No. 61/566,875 filed Dec. 5, 2011, which is incorporated herein by reference in its entirety.

BACKGROUND

1. Technical Field

Embodiments disclosed herein relate generally to cutting elements for drill bits or other tools incorporating the same. More specifically, embodiments disclosed herein relate generally to rotatable cutting elements for rotary drill bits.

2. Background Art

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the first category are generally known as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category are typically referred to as "fixed cutter" or "drag" bits. Drag bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

An example of a prior art PDC bit having a plurality of cutters with ultra hard working surfaces is shown in FIGS. 1 and 2. The drill bit 100 includes a bit body 110 having a threaded upper pin end 111 and a cutting end 115. The cutting end 115 typically includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 2, a top view of a prior art PDC bit is shown. The cutting face 118 of the bit shown includes a plurality of blades 120, wherein each blade has a leading side 122 facing the direction of bit rotation, a trailing side 124 (opposite from the leading side), and a top side 126. Each blade includes a plurality of cutting elements or cutters generally disposed radially from the center of cutting face 118 to generally form rows. Certain cutters, although at differing axial positions, may occupy radial positions that are in similar radial position to other cutters on other blades.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

Cracking (and/or formation of micro-cracks) in the bit body can also occur during the cutter brazing process in the area surrounding the cutter pockets. The formation and propagation of cracks in the matrix body during the drilling process may result in the loss of one or more PDC cutters. A lost cutter may abrade against the bit, causing further accelerated bit damage. FIG. 16 illustrates such cracking that can occur in a bit body using a conventional cutter.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mismatch between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a drill bit having a bit body, a plurality of blades extending radially from the bit body, wherein each blade comprises a leading face and a trailing face, a plurality of cutter pockets disposed on the plurality of blades, at least one rolling cutter, wherein each rolling cutter is disposed in one of the cutter pockets, and wherein each rolling cutter comprises a cutting face, a cutting edge, an outer circumferential surface, and a back face, a back retainer disposed adjacent to the back face, wherein the back retainer protrudes partially into the rolling cutter along a rotational axis of the rolling cutter, and a front retainer disposed adjacent to the at least one rolling cutter on the leading face of the blade. Each front retainer has a retention end, wherein the retention end is positioned adjacent to a portion of the cutting face of each rolling cutter and an attachment end, wherein the attachment end is attached to a portion of the blade.

In another aspect, embodiments of the present disclosure relate to a method of manufacturing a drill bit that includes forming a bit body comprising a threaded pin end and a cutting end, wherein at least one blade is formed on the cutting end, and wherein the blade has a plurality of cutter pockets formed therein, placing a rolling cutter into at least one of the plurality of cutter pockets, adjacent to a back retainer, wherein the rolling cutter comprises a substrate and a cutting face, and attaching an attachment end of a front retainer to a portion of the blade, such that a retention end of the front retainer covers a portion of the cutting face.

Other aspects and advantages of the invention will be apparent from the following description and the appended claims.

DETAILED DESCRIPTION

Figure 1:
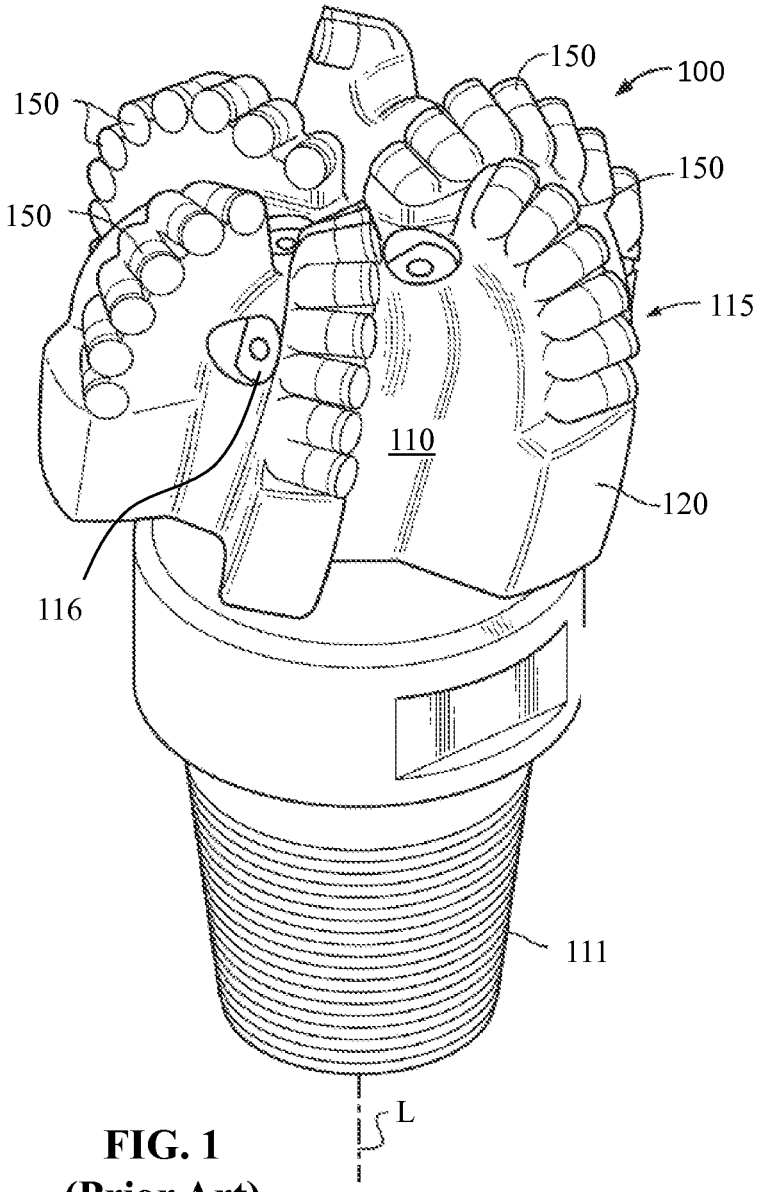
FIG. 1 (Prior Art)
FIG. 1 shows a side view of a conventional drag bit.
Figure 2:
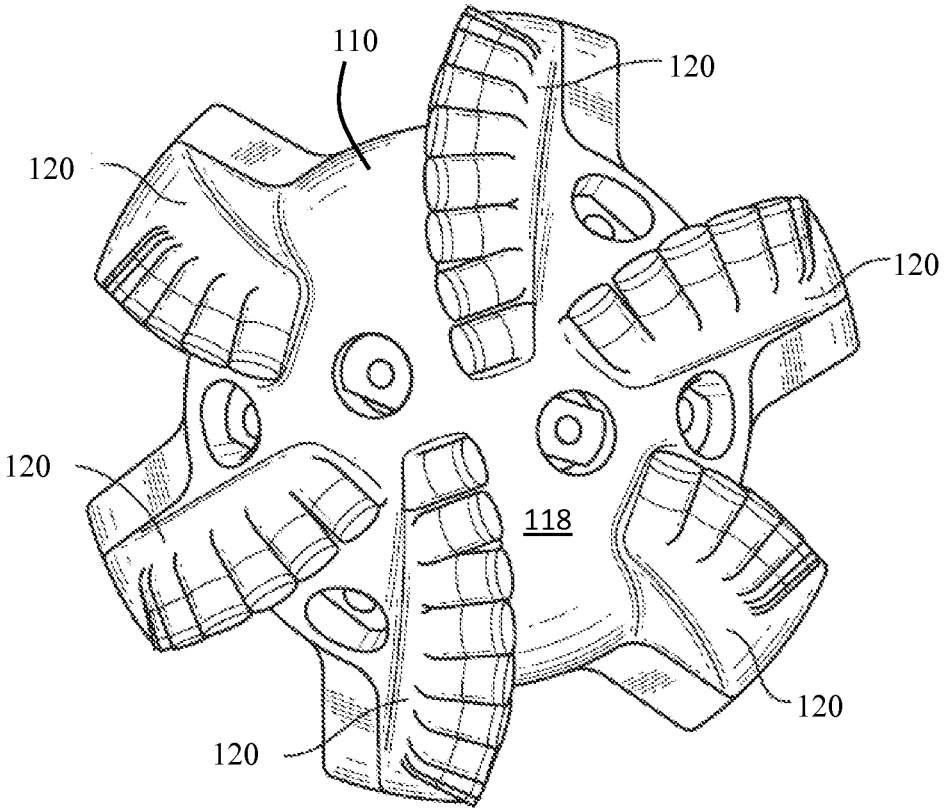
FIG. 2 (Prior Art)
FIG. 2 shows a top view of a conventional drag bit.

Drill bits according to embodiments of the present disclosure and methods for forming such drill bits are described below. According to some embodiments of the present disclosure, a drill bit may have a front retainer and a back retainer positioned adjacent to a rolling cutter. Rolling cutters of the present disclosure may be used on downhole cutting tools including, for example, drag bits and hybrid drill bits.

A rolling cutter, as referred to herein, is a cutting element having at least one surface that may rotate within a cutter pocket as the cutting element contacts the drilling formation. As the cutting element contacts the formation, shearing may allow a portion of the cutting element to rotate around a cutting element axis extending through a central plane of the cutting element. Rolling cutters according to the present disclosure are retained within the cutter pocket by a front retainer and a back retainer. As used herein, a front retainer is a component separate from the bit that is attached to the bit, adjacent to the cutting face of a rolling cutter to prevent the rolling cutter from coming out of the cutter pocket. In a particular embodiment, the front retainers of the present disclosure may be attached or coupled with the bit body in a position radially exterior to the rolling cutter. As used herein, a back retainer is a component separate from or integral with the bit, adjacent to the back face of a rolling cutter to prevent the rolling cutter from coming out of the cutter pocket. A rolling cutter and a corresponding front retainer and back retainer together may be referred to as a rolling cutter assembly.

Rotation of a portion of the cutting element may allow a cutting surface to cut formation using the entire outer edge (i.e., the entire circumferential edge) of the cutting surface, rather than the same section of the outer edge, as provided by the prior art. The entire edge of the cutting element may contact the formation, generating more uniform cutting element edge wear, thereby preventing for formation of a local wear flat area. Because the edge wear is more uniform, the cutting element may not wear as quickly, thereby having a longer downhole life, and thus increasing the overall efficiency of the drilling operation.

Rotatable cutting elements may also prevent or at least reduce high temperatures typically generated by fixed cutters during drilling. Because the cutting surface of prior art cutting elements is constantly contacting formation, heat may build-up that may cause failure of the cutting element due to fracture. Embodiments in accordance with the present disclosure may avoid this heat build-up because the edge contacting the formation changes. By decreasing the thermal and mechanical load experienced by the cutting surface of the cutting element, cutting element life may be increased, thereby allowing more efficient drilling.

Embodiments of the present disclosure may utilize back retainers and front retainers to retain rolling cutters to cutter pockets while also allowing the rolling cutters to rotate within the cutter pockets. Advantageously, means of retaining a rolling cutter in a cutter pocket described herein may allow for increased rolling cutter exposure (less cutter pocket coverage of the rolling cutter) and improved cleaning of the cutter pocket.

Figure 3:
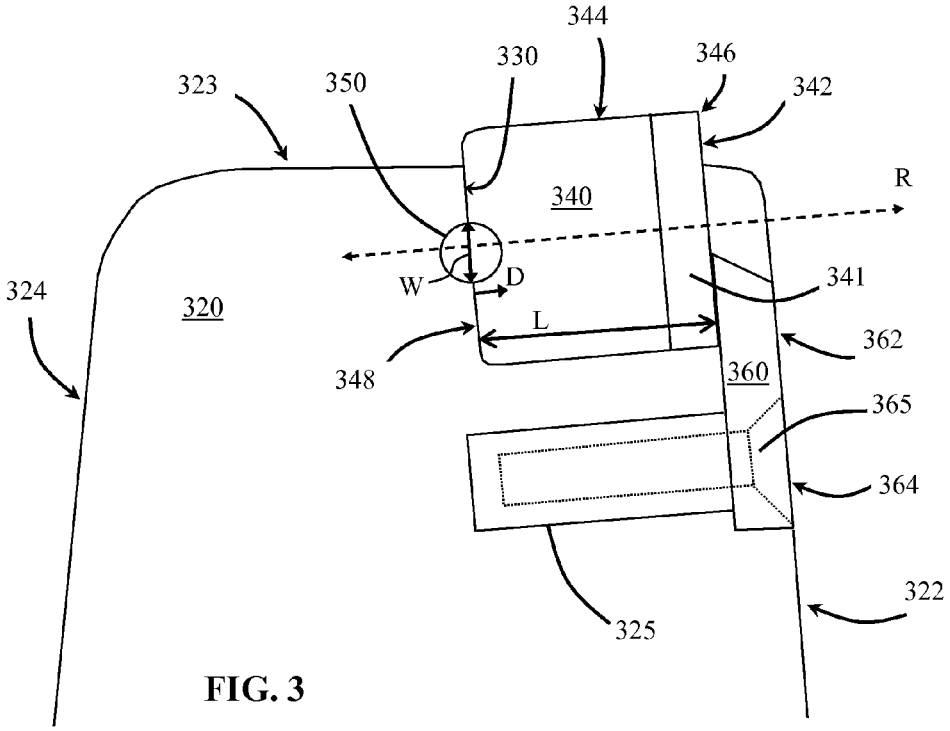
FIG. 3 shows a cross-sectional view of a rolling cutter according to embodiments of the present disclosure.

Drill bits according to embodiments of the present disclosure may include a bit body and a plurality of blades extending radially from the bit body, wherein the blades may have a plurality of cutter pockets disposed thereon. A rolling cutter may be retained within one or more cutter pockets using a back retainer and a front retainer according to embodiments of the present disclosure. For example, referring to FIGS. 3 and 4, cross-sectional views of a rolling cutter according to embodiments of the present disclosure are shown disposed within a cutter pocket on a bit blade. As shown in FIG. 3, a blade 320 may have a leading face 322, a top face 323 and a trailing face 324, wherein the leading face 322 faces in the direction of blade rotation. A cutter pocket 330 may be formed in the blade 320 at the leading face 322 of the blade, wherein a cutter pocket side surface intersects at the leading face 322 and top face 323 of the blade 320, and a cutter pocket back surface intersects the top face 323 of the blade 320. A rolling cutter 340 may be disposed in the cutter pocket 330, wherein the rolling cutter 340 has a cutting face 342, an outer circumferential surface 344, a cutting edge 346 formed at the intersection of the cutting face 342 and the outer circumferential surface 344, and a back face 348. Further, as shown, the rolling cutter 340 may have an abrasive material table 341, such as a polycrystalline diamond table, form the cutting face 342 of the rolling cutter.

Figure 4:
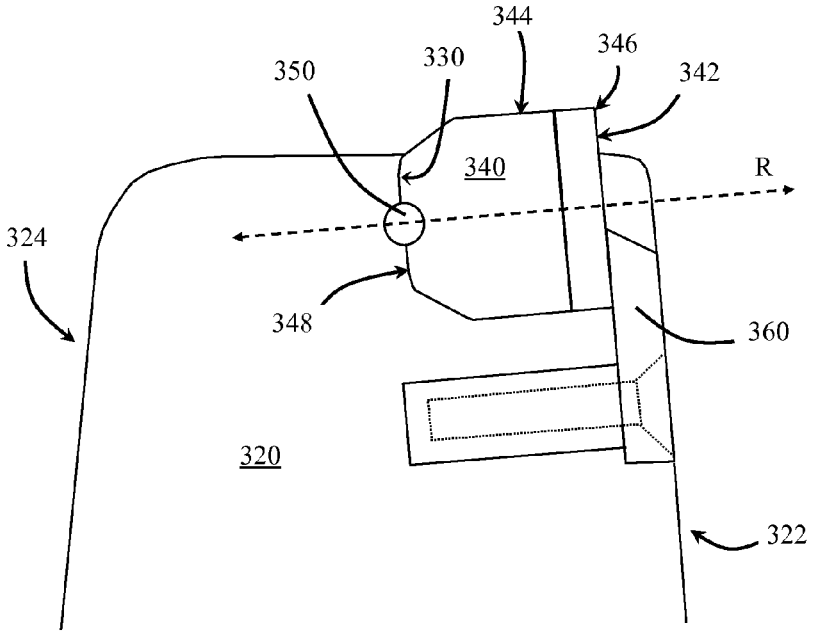
FIG. 4 shows a cross-sectional view of a rolling cutter according to embodiments of the present disclosure.

A back retainer 350 may be disposed in the cutter pocket 330 adjacent to the back face 348 of the rolling cutter 340, wherein the back retainer 350 protrudes partially into the rolling cutter 340 along a rotational axis R of the rolling cutter 340. The back retainer 350 may have a width W with an upper limit of 75% of the rolling cutter diameter. In other embodiments, a back retainer may have a width with an upper limit of 50% of the rolling cutter diameter. The width W of the back retainer depends on the material used to form the back retainer and the rolling cutter, but may have a lower limit of 10% of the rolling cutter diameter. According to embodiments disclosed herein, a back retainer may have a width with an upper limit of any of 75%, 50% and 25% of the rolling cutter diameter and a lower limit of any of 10%, 15% and 20% of the rolling cutter diameter. Additionally, the back retainer 350 may extend into the rolling cutter 340 a distance D of at least 10 percent of the length L of the rolling cutter 340 and up to a distance to an abrasive material table or to the rolling cutter cutting face (i.e., the entire length of the rolling cutter). Further, in embodiments having a back retainer that is a separate component from the blade, the back retainer may also extend a distance into the blade. For example, as shown in FIGS. 3 and 4, the back retainer 350 is disposed between the back face 348 of the rolling cutter 340 and the back surface of the cutter pocket 330, wherein the back retainer 350 protrudes partially into the rolling cutter 340 along the rotational axis R and extends partially into the blade 320. As shown, the back retainer 350 is a ball. However, according to other embodiments, a back retainer may have a cylindrical shape (such as a pin) or may have an irregular shape that protrudes into the blade and/or rolling cutter along the rotational axis of the rolling cutter.

A front retainer 360 may be disposed adjacent to the rolling cutter 340 on the leading face 322 of the blade 320. The front retainer 360 has a retention end 362 positioned adjacent to a portion of the cutting face 342 of the rolling cutter 340, and an attachment end 364 attached to a portion of the blade 320. As shown, the attachment end 364 of the front retainer 360 may be attached to a portion of the leading face 322 of the blade 320 by using a screw 365 or other like fastener. Specifically, the screw 365 may be inserted through a hole in the attachment end 364 of the front retainer 360 and into a threaded cavity 325 formed within the leading face 322 of the blade 320 below the cutter pocket 330. According to some embodiments, a threaded cavity may include a steel nut that has been infiltrated into the bit, wherein threads may be machined in the inside of the nut before or after infiltration, or just machined into the bit if the bit material is machinable. If threads are machined into the nut before infiltration, materials such as graphite may be used to protect the structure of the hole and threads during the infiltration process.

Front retainers of the present disclosure may include at least two functional portions: an attachment end, which acts as an attachment between the front retainer and the bit, and a retention end, which is located adjacent to the cutting face of a rolling cutter to retain the rolling cutter within a cutter pocket. A front retainer may be formed from various materials and have various shapes and sizes to prevent the rolling cutter from coming out of a cutter pocket formed in the bit. For example, a front retainer may be formed of a carbide material, such as tungsten carbide. Additionally, some embodiments of front retainers may have diamond, such as on the portion of the front retainer that is proximate to the cutting face of a rolling cutter once assembled.

Figure 25:
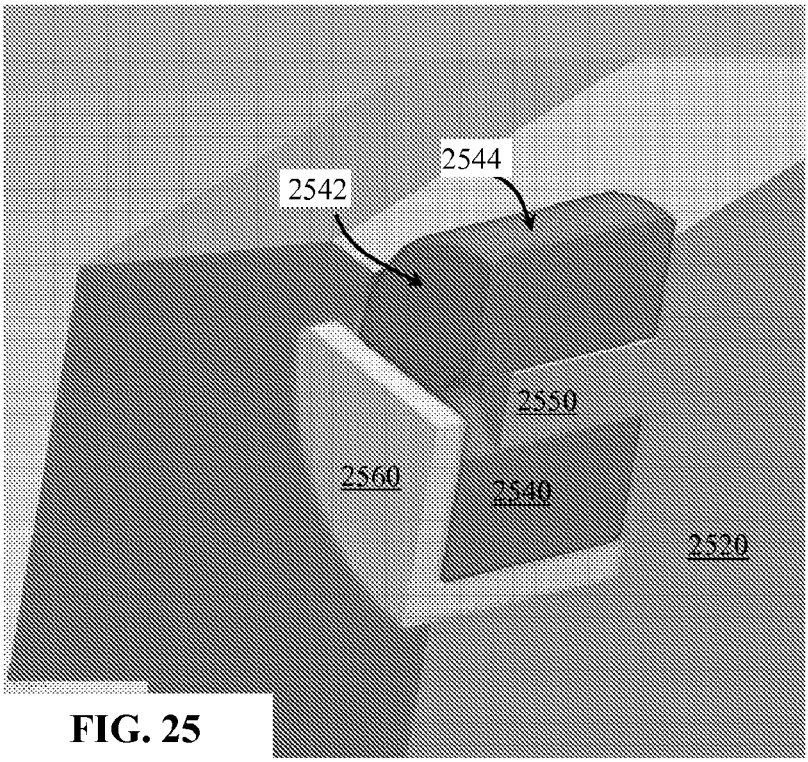
FIGS. 25 and 26 show a cross-sectional view and a perspective view of a rolling cutter according to embodiments of the present disclosure.
Figure 26:
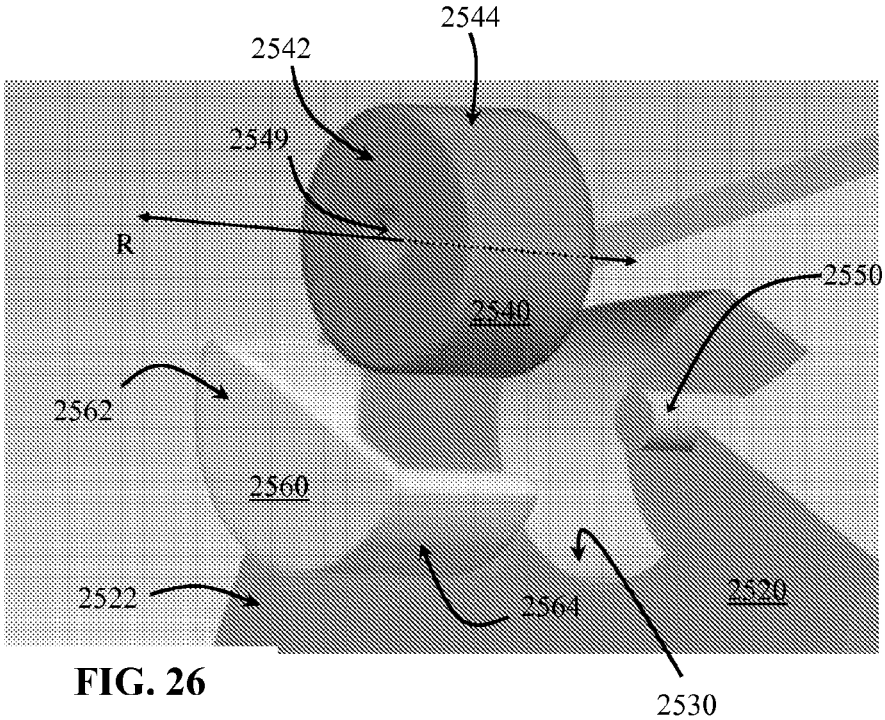

For example, FIGS. 25-26 show another embodiment of a front retainer that may be used in conjunction with a back retainer to retain a rolling cutter within a cutter pocket. As shown, a rolling cutter 2540 may be retained within a cutter pocket 2530 formed at the leading face 2522 of a blade 2520 using a back retainer 2550 and a front retainer 2560, wherein the back retainer 2550 is a pin and integrally formed with the blade 2520. The rolling cutter 2540 has a cutting face 2542, an outer circumferential surface 2544 and a back face. The back retainer 2550 protrudes into a hole 2549 formed in the rolling cutter 2540 along a rotational axis R of the rolling cutter 2540, such that the rolling cutter 2540 may rotate about the back retainer 2550. The front retainer 2560 has a retention end 2562 positioned adjacent to a portion of the cutting face 2542 of the rolling cutter 2540, and an attachment end 2564 attached to a portion of the blade 2520. As shown, the attachment end 2564 of the front retainer 60 may form a portion of the cutter pocket 2530, wherein the rolling cutter 2540 may interface with and rotate within the attachment end 2564 of the front retainer 2560. The attachment end 2564 may be attached to a portion of the leading face 2522 of the blade 2520 by brazing. Other embodiments of front retainers that may be used to retain the rolling cutter within the cutter pocket may be found in U.S. application Ser. No. 13/152,626 also published as U.S. Publication No. 2011/0297454, which is hereby incorporated by reference in its entirety.

Referring again to FIG. 4, a cross-sectional view of another rolling cutter according to embodiments of the present disclosure disposed within a cutter pocket on a bit blade. As shown, a blade 320 may have a leading face 322 and a trailing face 324, wherein the leading face 322 faces in the direction of blade rotation. A rolling cutter 340 may be disposed in a cutter pocket 330 formed at the leading face 322 of the blade. The rolling cutter 340 has a cutting face 342, an outer circumferential surface 344, a cutting edge 346 formed at the intersection of the cutting face 342 and the outer circumferential surface 344, and a back face 348. Further, as shown, the rolling cutter 340 may have an abrasive material table 341, such as a polycrystalline diamond table, form the cutting face 342 of the rolling cutter. A back retainer 350 may be disposed adjacent to the back face 348 of the rolling cutter 340, wherein the back retainer 350 protrudes partially into the rolling cutter 340 along a rotational axis R of the rolling cutter 340, and a front retainer 360 may be disposed adjacent to the rolling cutter 340 on the leading face 322 of the blade 320.

The cutting edge (the intersection of the cutting face and the outer circumferential surface) as shown in FIG. 4 forms a substantially perpendicular intersection. However, according to some embodiments, the cutting edge may have a bevel formed at the intersection of the cutting face and the outer circumferential surface. Likewise, some embodiments of rolling cutters may have a bevel formed at the intersection of the back face and the outer circumferential surface. According to other embodiments, such as shown in FIG. 4, the back face 348 of the rolling cutter 340 may have a conical shape, wherein the intersection between the back face and outer circumferential surface forms an obtuse angle. In some embodiments of rolling cutters having a conical shaped back face, the transition from the back face to the outer circumferential surface may be gradual and continuous rather than forming an intersection angle. Other embodiments of rolling cutters having a conical shaped back face are described in U.S. patent application Ser. No. 13/456,352 also published as U.S. Publication No. 2012/0273280, which is hereby incorporated by reference. The cutter pocket 330 may have a shape substantially corresponding to the rolling cutter back face 348 and outer circumferential surface 344 shape, such that the rolling cutter 340 may smoothly rotate within the cutter pocket 330.

Figure 5:
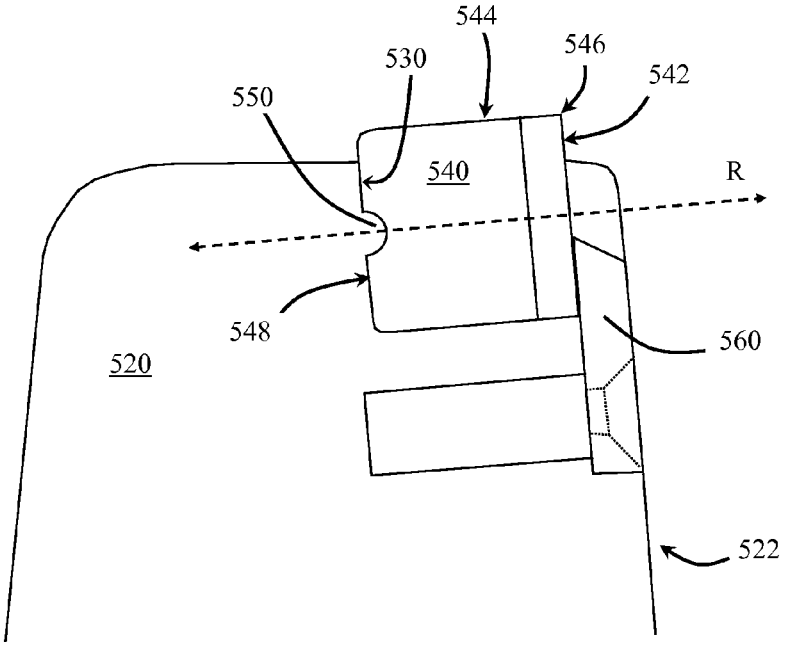
FIG. 5 shows a cross-sectional view of a rolling cutter according to embodiments of the present disclosure.
Figure 6:
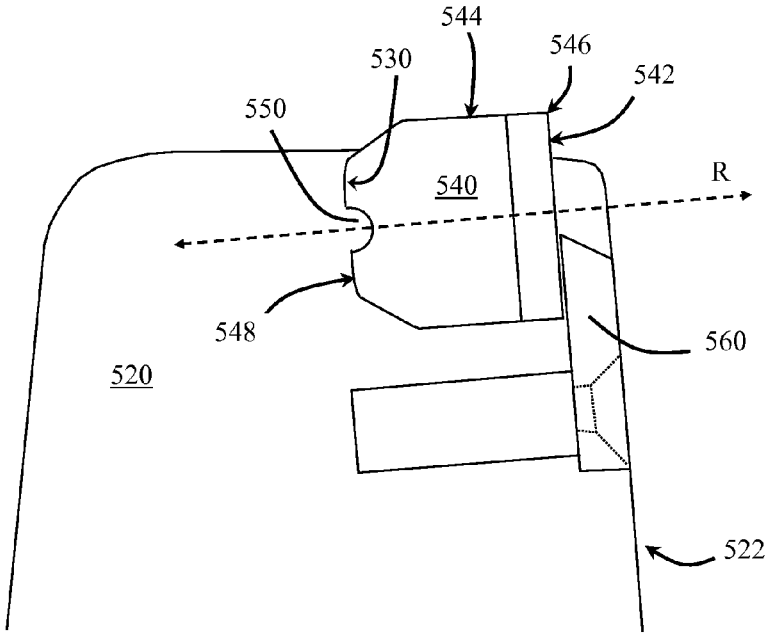
FIG. 6 shows a cross-sectional view of a rolling cutter according to embodiments of the present disclosure.

Referring now to FIGS. 5 and 6, a rolling cutter 540 may be retained within a cutter pocket 530 formed at the leading face 522 of a bit blade 520 using a back retainer 550 and a front retainer 560, wherein the back retainer 550 is integral with the bit. The rolling cutter 540 has a cutting face 542, an outer circumferential surface 544, a cutting edge 546 formed at the intersection of the cutting face 542 and the outer circumferential surface 544, and a back face 548. As shown in FIG. 5, the intersection between the back face 548 and the outer circumferential surface 544 of the rolling cutter 540 may form a substantially perpendicular intersection, such that the back face end of the rolling cutter has a cylindrical shape. However, according to other embodiments, such as shown in FIG. 6, the back face 548 of the rolling cutter 540 may have a conical shape, wherein the intersection between the back face and outer circumferential surface forms an obtuse angle. In some embodiments of rolling cutters having a conical shaped back face, the transition from the back face to the outer circumferential surface may be gradual and continuous rather than forming an intersection angle.

The back retainer 550 is disposed adjacent to the back face 548 of the rolling cutter 540, wherein the back retainer 550 protrudes partially into the rolling cutter 540 along a rotational axis R of the rolling cutter 540, and a front retainer 560 may be disposed adjacent to the rolling cutter 540 on the leading face 522 of the blade 520. Particularly, embodiments having a back retainer integrally formed with a blade may have the back retainer formed at on the back surface of the cutter pocket, such that when a rolling cutter is positioned adjacent to the back retainer, the rolling cutter is able to rotate about the back retainer and within the cutter pocket. Thus, in such embodiments, the shape of the integrally formed cutter pocket and back retainer substantially corresponds with the shape of the back face and outer circumferential surface of the rolling cutter. As shown in FIGS. 5 and 6, the back retainer 550 may have a hemispherical shape protruding from the back surface of the cutter pocket. However, according to other embodiments, a back retainer may have other shapes, such as conical or cylindrical, wherein a correspondingly shaped hole formed in the back face of a rolling cutter may mate with and rotate about the back retainer shape.

Figure 7:
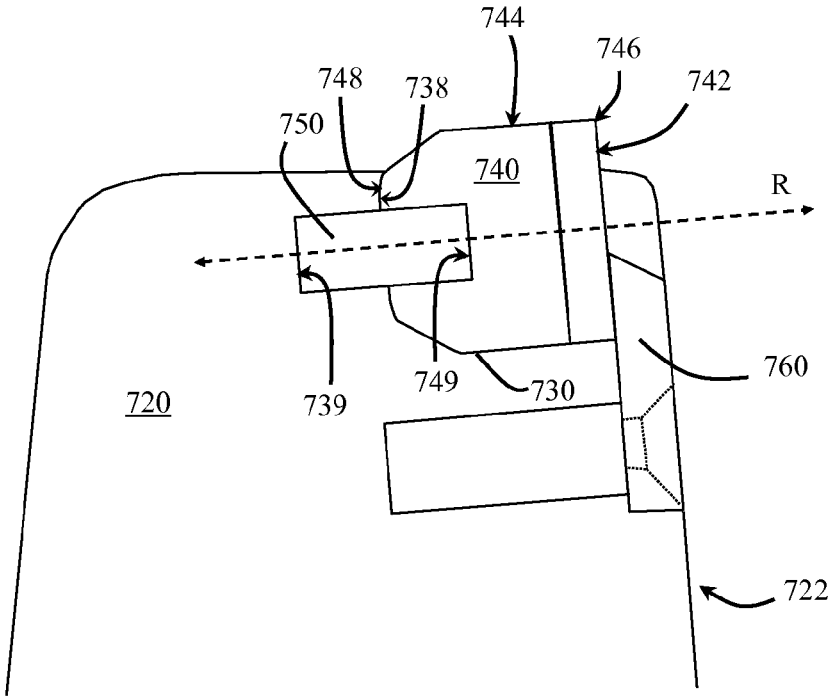
FIG. 7 shows a cross-sectional view of a rolling cutter according to embodiments of the present disclosure.
Figure 8:
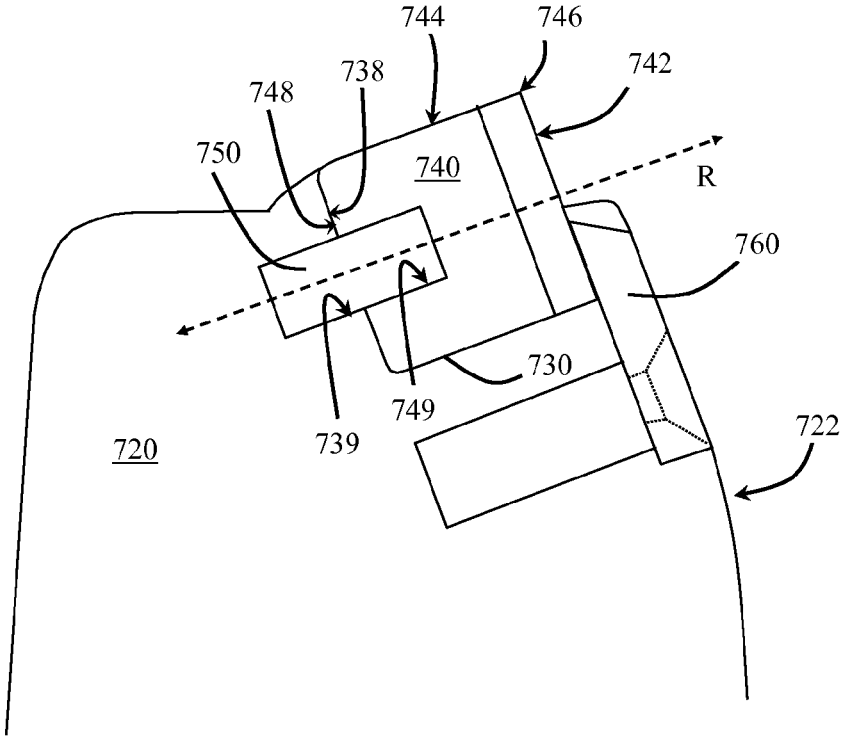
FIG. 8 shows a cross-sectional view of a rolling cutter according to embodiments of the present disclosure.

For example, referring now to FIGS. 7 and 8, a back retainer may be a cylindrical shaped pin. As shown, a rolling cutter 740 may be retained within a cutter pocket 730 formed at the leading face 722 of a bit blade 720 using a back retainer 750 and a front retainer 760, wherein the back retainer 750 is a pin and a separate component from the blade. The rolling cutter 740 has a cutting face 742, an outer circumferential surface 744, a cutting edge 746 formed at the intersection of the cutting face 742 and the outer circumferential surface 744, and a back face 748. The back retainer 750 protrudes partially into the rolling cutter 740 along a rotational axis R of the rolling cutter 740. As shown, the back retainer 750 mates with a corresponding shaped hole 749 formed in the back face 748 of the rolling cutter 740, such that the rolling cutter 740 may rotate about the back retainer 750.

Further, in embodiments having a back retainer that is a separate component from the blade, the back retainer may be disposed in a hole formed in the back surface of a cutter pocket. For example, as shown in FIGS. 7 and 8, a back retainer 750 is disposed in a cutter pocket hole 739 formed in the back surface 738 of the cutter pocket 730. The back retainer 750 may be attached to the cutter pocket hole 739 by means known in the art, such as brazing or interference fitting, so that the back retainer 750 does not rotate within the cutter pocket hole 739 as the rolling cutter 740 rotates about the back retainer 750. Alternatively, in other embodiments, a back retainer may not be attached to the cutter pocket or the rolling cutter, such that the back retainer may rotate with respect to each of the cutter pocket and the rolling cutter. As shown, the shape of the back face 748 of the rolling cutter 740 mates with the shape of the back retainer 750 and the back surface 738 of the cutter pocket 730. For example, the back face 748 of the rolling cutter 740 shown in FIG. 7 forms a conical shape having a hole 749 formed therein, wherein the back face 748 intersects with the outer circumferential surface 744 at an obtuse angle, and the back surface 738 of the cutter pocket 730 forms a substantially mating conical pocket, wherein the back surface 738 of the cutter pocket intersects the side surface of the cutter pocket 730 at substantially the same obtuse angle. As used herein, a "substantially mating" geometry includes a gap between the rolling cutter and the corresponding cutter pocket surface to allow the rolling cutter to rotate within the cutter pocket. In another example shown in FIG. 8, the back face 748 intersects with the outer circumferential surface 744 at a substantially perpendicular angle, and the back surface 738 of the cutter pocket 730 intersects the side surface of the cutter pocket 730 at substantially the same perpendicular angle to form a substantially mating pocket.

Figure 9:
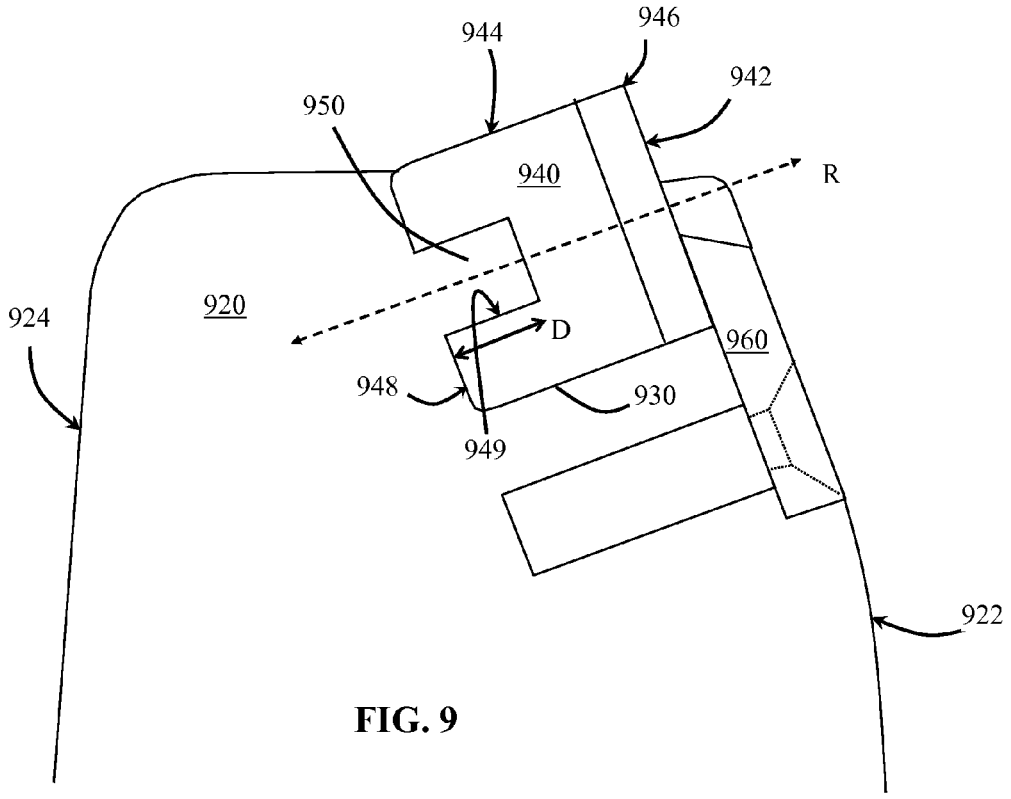
FIG. 9 shows a cross-sectional view of a rolling cutter according to embodiments of the present disclosure.
Figure 10:
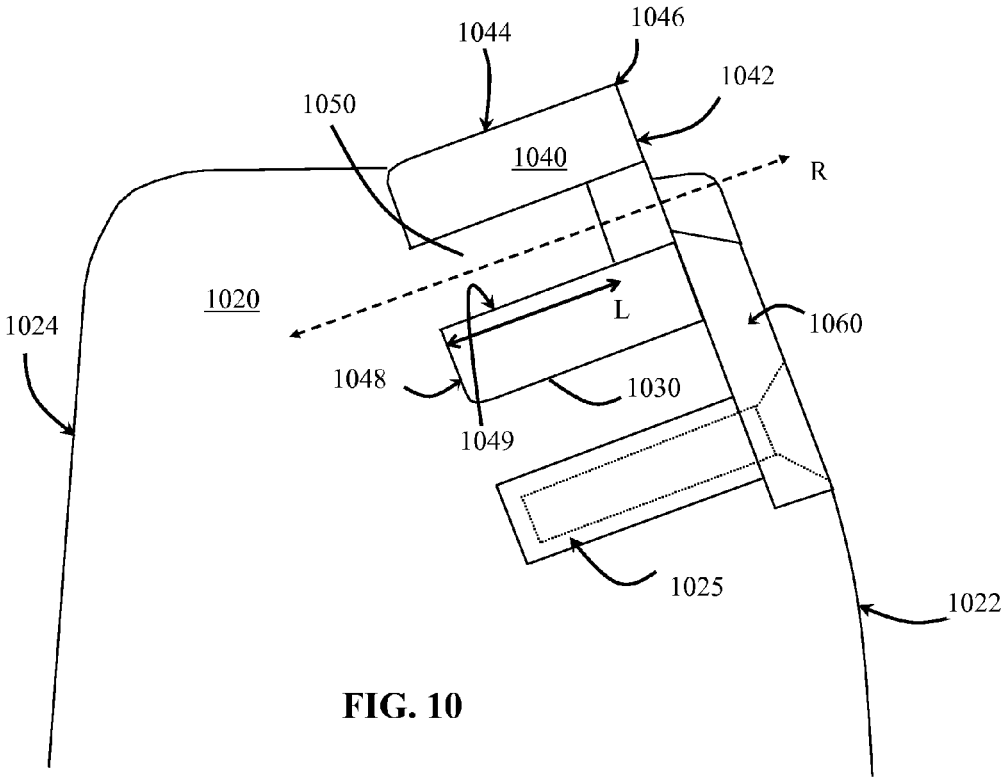
FIG. 10-12 show a cross-sectional view and perspective views, respectively, of a rolling cutter according to embodiments of the present disclosure.

Referring now to FIGS. 9-12, a back retainer 950 having a cylindrical pin shape may be integrally formed with a blade 920. Particularly, a rolling cutter 940 may be retained within a cutter pocket 930 formed at the leading face 922 of the blade 920 using a back retainer 950 and a front retainer 960, wherein the back retainer 950 is a pin and integrally formed with the blade 920. The rolling cutter 940 has a cutting face 942, an outer circumferential surface 944, a cutting edge 946 formed at the intersection of the cutting face 942 and the outer circumferential surface 944, and a back face 948. The back retainer 950 protrudes into a hole 949 formed in the back face 948 of the rolling cutter 940 along a rotational axis R of the rolling cutter 940, such that the rolling cutter 940 may rotate about the back retainer 950. Further, as shown in FIG. 9, the back retainer 950 may extend a distance D substantially equal to the length of the hole 949, such that the back retainer 950 mates with the rolling cutter hole 949. In other embodiments, such as shown in FIGS. 10, 13, and 25 the back retainer may extend a partial length of a rolling cutter hole.

Figure 11:
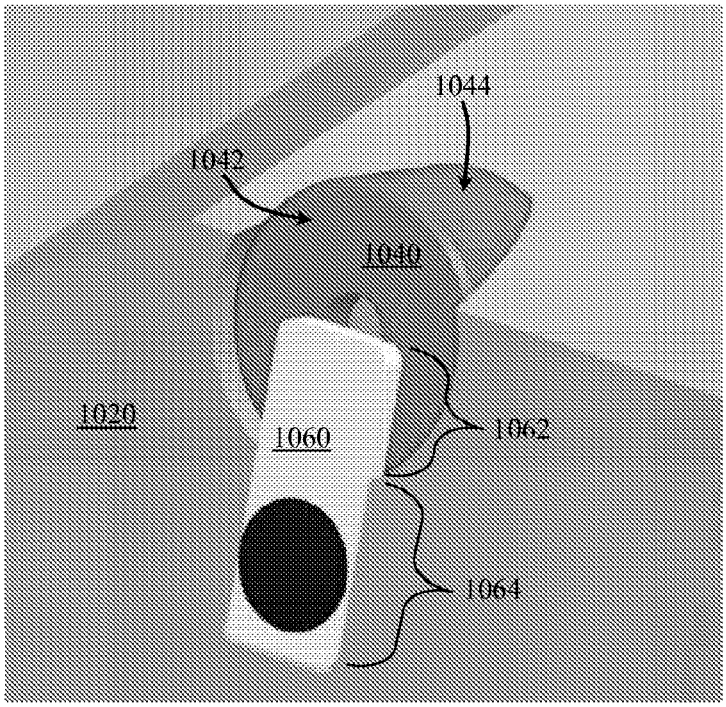
Figure 12:
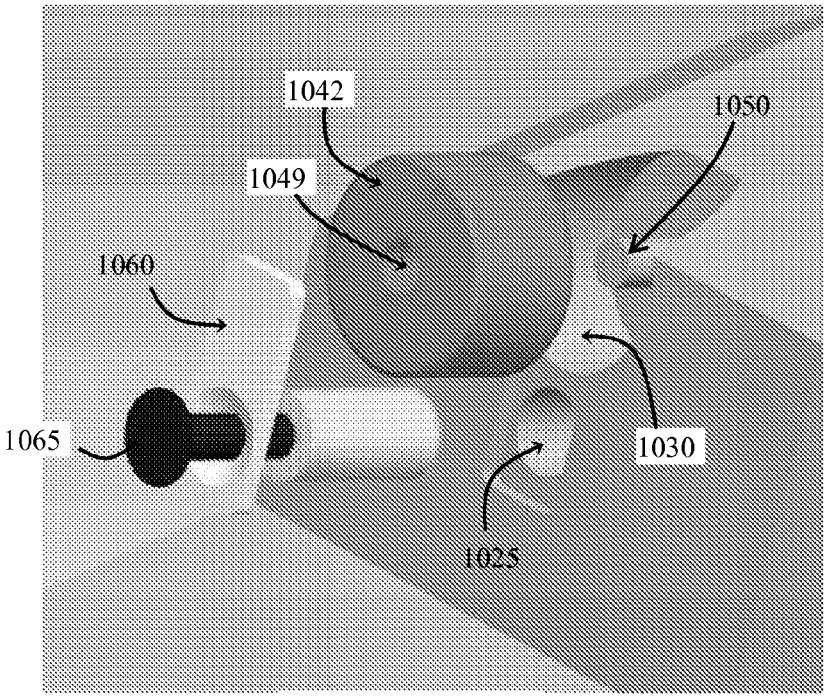

Particularly, FIG. 10 shows a cross-sectional view of a rolling cutter retained to a blade with a front retainer and a back retainer, wherein the back retainer extends a partial length of a hole formed in the rolling cutter. FIGS. 11 and 12 show perspective views of the embodiment shown in FIG. 10. As shown, the rolling cutter 1040 has a cutting face 1042, an outer circumferential surface 1044, a cutting edge 1046 formed at the intersection of the cutting face 1042 and the outer circumferential surface 1044, and a back face 1048. The rolling cutter 1040 is retained within a cutter pocket 1030 formed at the leading face 1022 of a blade 1020 by a back retainer 1050 and a front retainer 1060. The back retainer 1050 protrudes into a hole 1049 formed in the back face 1048 of the rolling cutter 1040 along a rotational axis R of the rolling cutter 1040, such that the rolling cutter 1040 may rotate about the back retainer 1050. As shown, the hole 1049 extends the entire length of the rolling cutter 1040 along the rotational axis R, from the back face 1048 to the cutting face 1042. However, in other embodiments, the hole 1049 may extend less than the entire length of the rolling cutter. Further, the back retainer 1050 extends a partial length of the hole 1049. Particularly, the back retainer 1050 may extend into the hole 1049 of the rolling cutter 1040 a distance D of at least 10 percent of the length of the rolling cutter 1040, which may be less than or substantially equal to the length of the hole 1049 within the rolling cutter 1040.

Additionally, as shown in FIGS. 10-12, a front retainer 1060 may be disposed adjacent to the rolling cutter 1040 on the leading face 1022 of the blade 1020. The front retainer 1060 has a retention end 1062 positioned adjacent to a portion of the cutting face 1042 of the rolling cutter 1040, and an attachment end 1064 attached to a portion of the blade 1020. A screw 1065 may be inserted through a hole in the attachment end 1064 of the front retainer 1060 and into a threaded cavity 1025 in the leading face 1022 of the blade 1020 below the cutter pocket 1030 in order to attach the front retainer 1060 to the blade 1020. As shown, the threaded cavity may include a steel nut 1025 that has been infiltrated into the blade 1020, wherein threads may be machined in the inside of the nut before or after infiltration.

Figure 13:
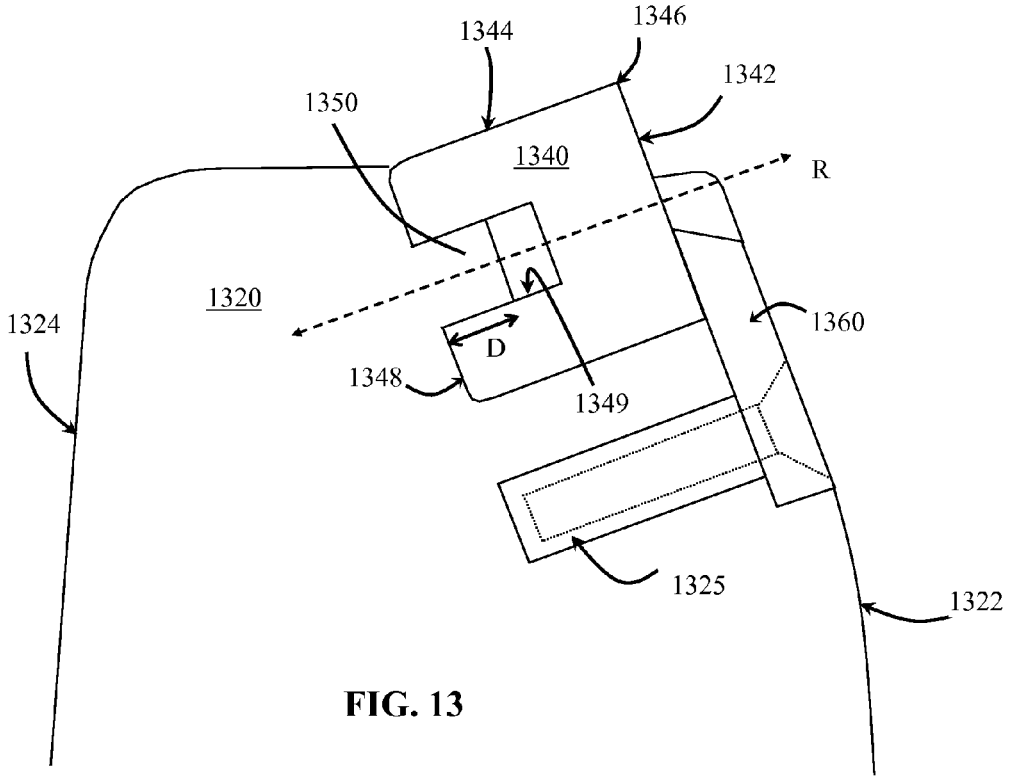
FIG. 13 shows a cross-sectional view of a rolling cutter according to embodiments of the present disclosure.

FIG. 13 shows a cross-sectional view of another embodiment of a rolling cutter retained to a blade with a front retainer and a back retainer, wherein the back retainer extends a partial length of a hole formed in the rolling cutter. As shown, the rolling cutter 1340 has a cutting face 1342, an outer circumferential surface 1344, a cutting edge 1346 formed at the intersection of the cutting face 1342 and the outer circumferential surface 1344, and a back face 1348. The back retainer 1350 protrudes into a hole 1349 formed in the back face 1348 of the rolling cutter 1340 along a rotational axis R of the rolling cutter 1340, such that the rolling cutter 1340 may rotate about the back retainer 1350. As shown, the hole 1349 extends a partial length of the rolling cutter 1340 along the rotational axis R, from the back face 1348 of the rolling cutter 1340. Further, the back retainer 1350 extends a partial length of the hole 1349. Particularly, the back retainer 1350 may extend into the hole 1349 of the rolling cutter 1340 a distance D of at least 10 percent of the length of the rolling cutter 1340, which may be less than or substantially equal to the length of the hole 1349 within the rolling cutter 1340.

Figure 14:
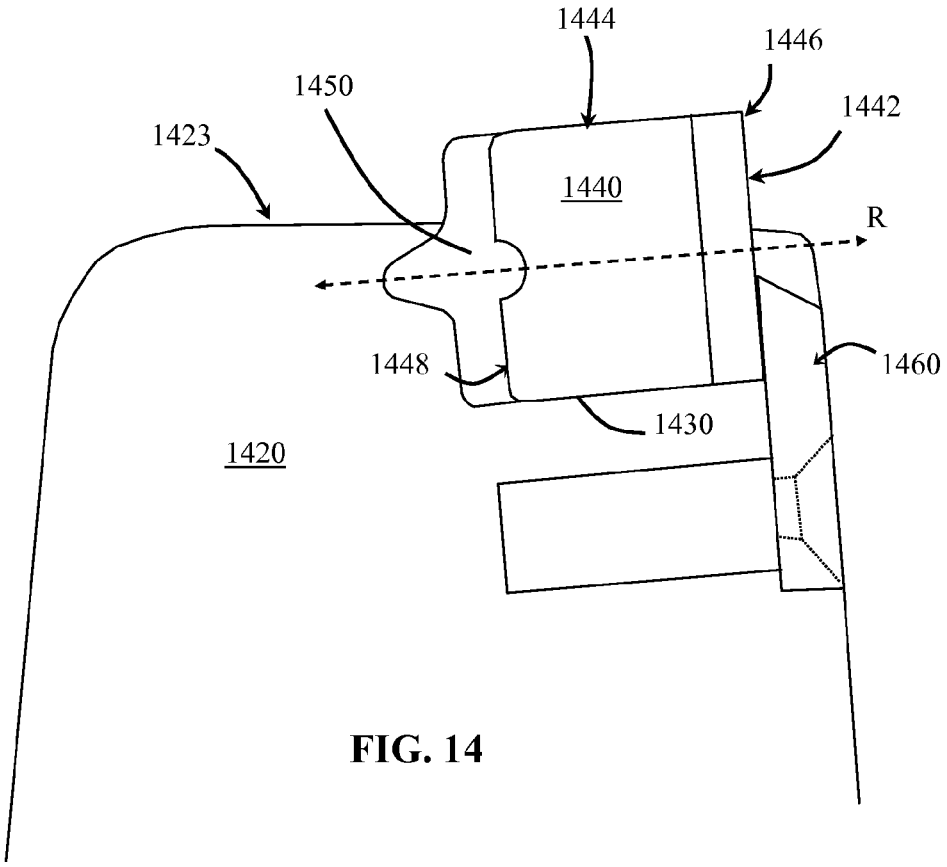
FIG. 14 shows a cross-sectional view of a rolling cutter according to embodiments of the present disclosure.

According to other embodiments of the present disclosure, a back retainer may be infiltrated into a cutter pocket. For example, as shown in FIG. 14, a rolling cutter 1440 having a cutting face 1442, an outer circumferential surface 1444, a cutting edge 1446 formed at the intersection of the cutting face 1442 and the outer circumferential surface 1444, and a back face 1448 is disposed in a cutter pocket 1430 formed in a blade 1420. The rolling cutter 1440 is retained within the cutter pocket 1430 using a back retainer 1450 and a front retainer 1460. The back retainer 1450 protrudes a distance into the back face 1448 of the rolling cutter 1440 along a rotational axis R of the rolling cutter 1440, such that the rolling cutter 1440 may rotate about the back retainer 1450. Further, a portion of the back retainer 1450 may extend adjacent to the back face 1448 of the rolling cutter 1440 rather than into the back face 1448. The portion of the back retainer 1450 extending adjacent to the back face 1448 may extend above a top face 1423 of the blade 1420. The back retainer 1450 may be infiltrated into the blade. Further, as shown, the back retainer 1450 has a conical shape protruding into the blade 1420 and a hemispherical shape protruding into the rolling cutter 1440. However, in other embodiments, a back retainer may have other shapes.

Figure 15:
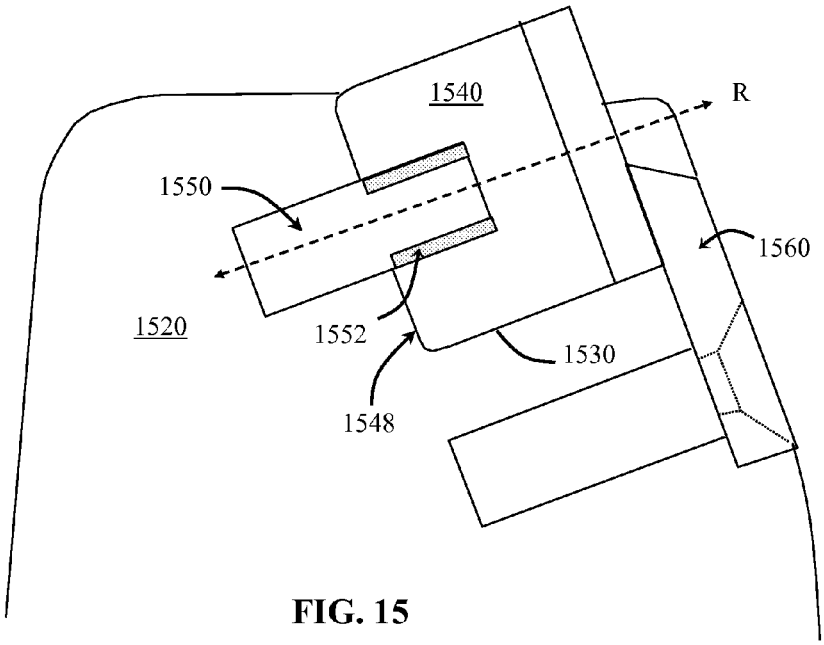
FIG. 15 shows a cross-sectional view of a rolling cutter according to embodiments of the present disclosure.
Figure 16:
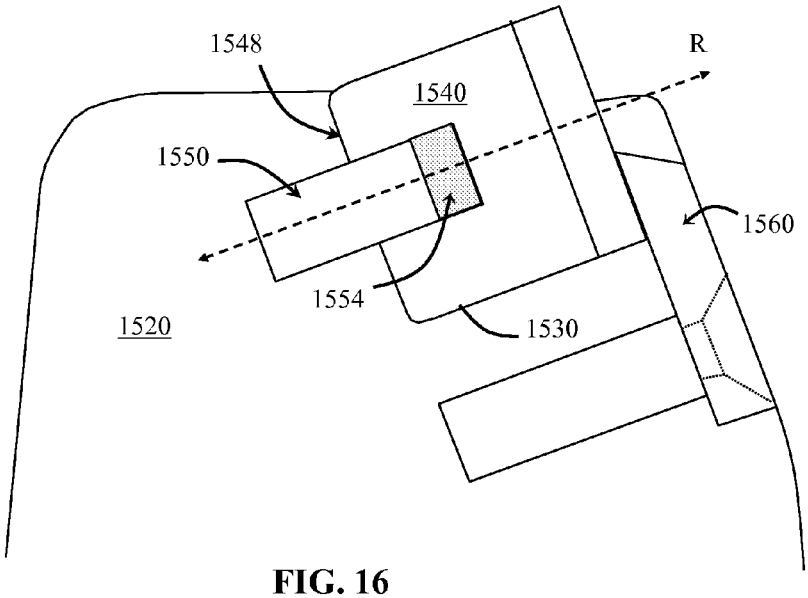
FIG. 16 shows a cross-sectional view of a rolling cutter according to embodiments of the present disclosure.

Further, a back retainer may be made of the same material as the blade or a different material than the blade. According to embodiments of the present disclosure, a back retainer may be made of, for example, materials selected from a metal, a carbide material, such as tungsten carbide, hardened tool steel, ceramics, cubic boron nitride and diamond, such as polycrystalline diamond. For example, a back retainer may have diamond disposed at one or more interfacing surfaces with the rolling cutter, such as with the rolling cutter back face, to form a bearing surface. FIGS. 15 and 16 show some embodiments of a back retainer having diamond. Particularly, as shown in FIGS. 15 and 16, a rolling cutter 1540 is retained within a cutter pocket 1530 using a back retainer 1550 and a front retainer 1560. The back retainer 1550 protrudes a distance into the back face 1548 of the rolling cutter 1540 along a rotational axis R of the rolling cutter 1540, such that the rolling cutter 1540 may rotate about the back retainer 1550. The back retainer 1550 shown in FIG. 15 has a diamond band 1552 formed around the side surface of the back retainer. The back retainer shown in FIG. 16 has a polycrystalline diamond table 1554 formed at the end of the back retainer interfacing the rolling cutter 1540. However, according to other embodiments, diamond may be formed at different positions on a back retainer.

Figure 17:
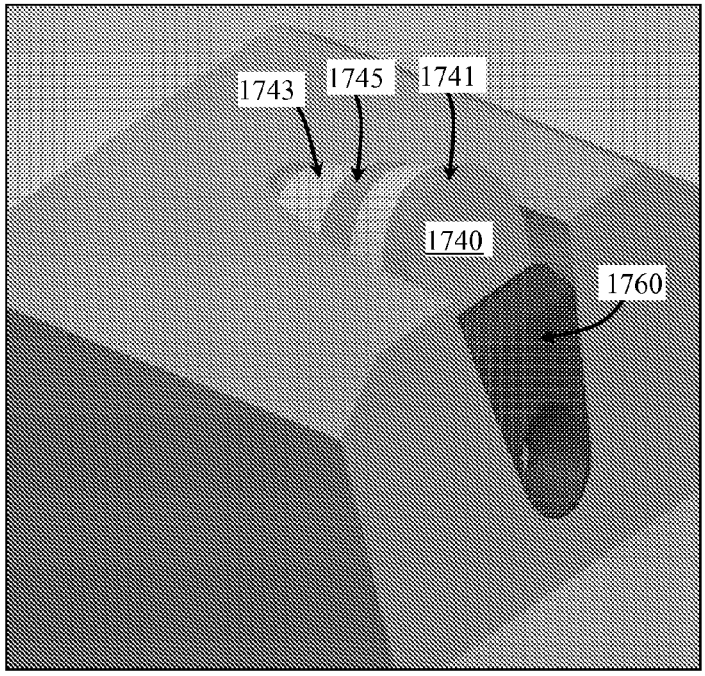
FIGS. 17 and 18 show a perspective view and a cross-sectional view, respectively, of a rolling cutter according to embodiments of the present disclosure.
Figure 18:
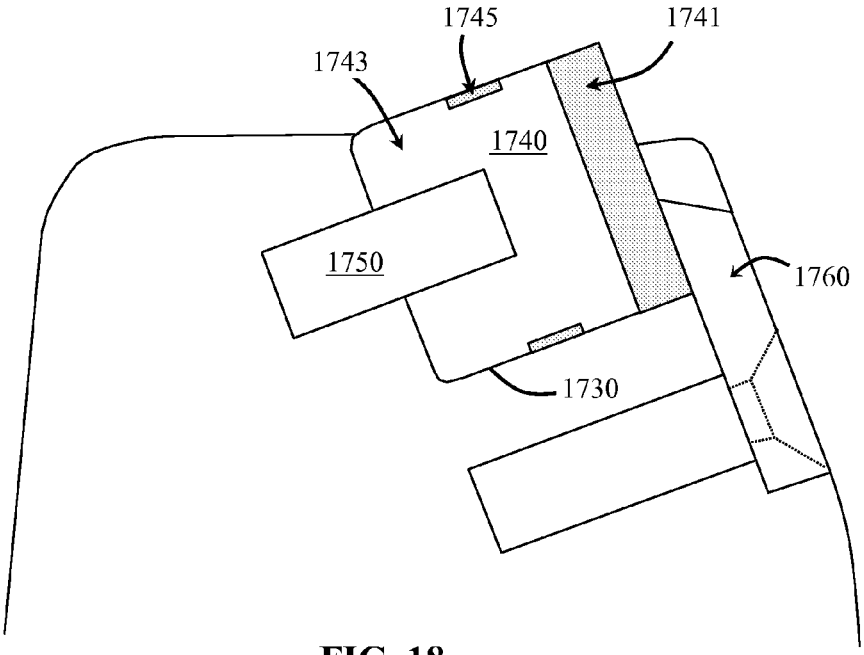

Rolling cutters according to embodiments of the present disclosure may be formed of material including, for example, metal, carbides, such as tungsten carbide, tantalum carbide, or titanium carbide, nitrides, ceramics and diamond, such as polycrystalline diamond, or a combination thereof. For example, referring to FIGS. 17 and 18, a perspective view and a cross-sectional view, respectively, is shown of a rolling cutter 1740 retained in a cutter pocket 1730 by a back retainer 1750 and a front retainer 1760. The rolling cutter 1740 has a diamond table 1741 formed on a carbide substrate 1743, wherein a diamond band 1745 is formed around the circumference of the substrate 1743. The carbide substrate 1743 may include metal carbide grains, such as tungsten carbide, supported by a matrix of a metal binder. Various binding metals may be present in the substrate, such as cobalt, nickel, iron, alloys thereof, or mixtures, thereof. In a particular embodiment, the substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes only, and no limitation on the type of carbide or binder use is intended.

The diamond table 1741 may include polycrystalline diamond ("PCD") having a plurality of diamond particles bonded together to form a three-dimensional diamond network where a metallic phase, such as cobalt or other Group VIII metal, may be present in the interstitial regions disposed between the diamond particles. In particular, as used herein, "polycrystalline diamond" or "a polycrystalline diamond material" refers to this three-dimensional network or lattice of bonded together diamond grains. Specifically, the diamond to diamond bonding is catalyzed by a metal (such as cobalt) by a high temperature/high pressure process, whereby the metal remains in the regions between the particles. Thus, the metal particles added to the diamond particles may function as a catalyst and/or binder, depending on the exposure to diamond particles that can be catalyzed as well as the temperature/pressure conditions. Further, the polycrystalline diamond may be leached to remove (or render non-catalyzing) the catalyst/binder material from the diamond structure to form thermally stable polycrystalline diamond ("TSP"). One skilled in the art may appreciate that methods know in the art of forming TSP may be used to form the diamond table 1741. Further, diamond composites, such as diamond/silicon or diamond/carbide composites, may be used to form the diamond table 1741.

Figure 19:
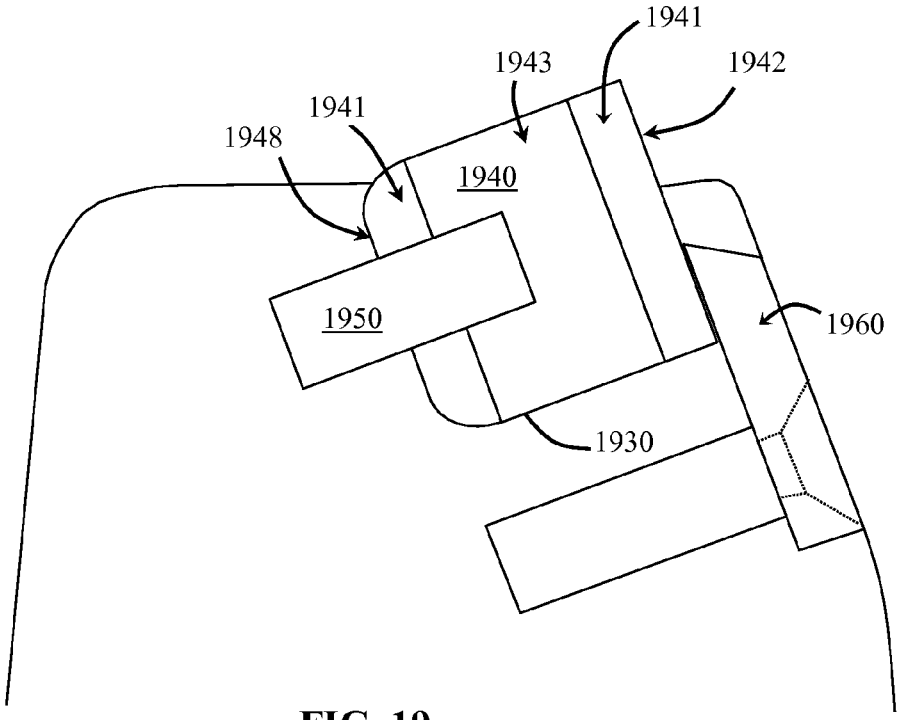
FIG. 19 shows a cross-sectional view of a rolling cutter according to embodiments of the present disclosure.

FIG. 19 shows a cross-sectional view of another embodiment having a rolling cutter 1940 formed of a carbide material and diamond, wherein the rolling cutter 1940 is retained within a cutter pocket 1930 by a front retainer 1960 and a back retainer 1950. The rolling cutter 1930 may have more than one diamond table 1941 formed on a substrate 1943, wherein the diamond table 1941 may form both the rolling cutter cutting face 1942 and the rolling cutter back face 1948. Further, although the examples in FIGS. 17-19 include a rolling cutter formed of a carbide substrate having diamond layers formed thereon, rolling cutters of the present disclosure may include other combinations of materials.

Figure 20:
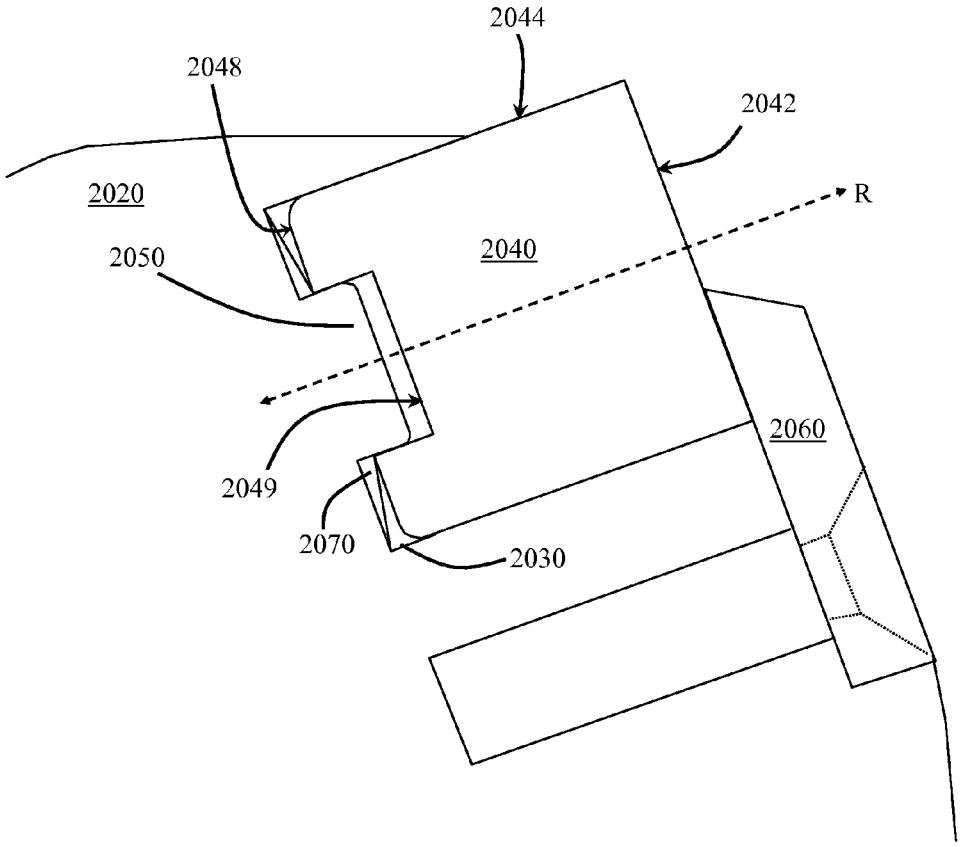
FIG. 20 shows a cross-sectional view of a rolling cutter according to embodiments of the present disclosure.

According to embodiments of the present disclosure, disc springs may be retained with rolling cutters within a cutter pocket by a back retainer and front retainer. For example, referring to FIG. 20, a cross-sectional view is shown of a disc spring 2070 disposed between a rolling cutter 2040 and a cutter pocket 2030 formed within a cutting tool blade 2020. The rolling cutter 2030 is retained within the cutter pocket 2030 by a back retainer 2050 and a front retainer 2060, wherein the rolling cutter has a cutting face 2042, an outer circumferential surface 2044 and a back face 2048. As shown, the disc spring 2070 is disposed at the back surface of the cutter pocket 2030, adjacent to the back face 2048 of the rolling cutter 2040. The back retainer 2050 extends through the disc spring 2070 and a distance into a hole 2049 formed in the rolling cutter 2040, along the rotational axis R of the rolling cutter. However, according to other embodiments, a disc spring may be disposed within a hole formed in back face of a rolling cutter, between the back retainer and the rolling cutter. Advantageously, use of a disc spring in rolling cutter assemblies of the present disclosure may reduce contact area between the rolling cutter back face and the back surface of the cutter pocket. Additionally, the disc spring vibration allows the rolling cutter to move in an axial direction, which may assist in breaking up formation cuttings, as well as preventing cutting debris buildup. In particular, a disc spring may prevent cutting debris from packing between the cutting face of the rolling cutter and the front retainer. Further, the slight axial movement provided by the disc spring may inhibit the rolling cutter from being bound to the cutter pocket due to buildup of cutting debris within the gap between the rolling cutter outer diameter and the cutter pocket inner diameter.

Figure 21:
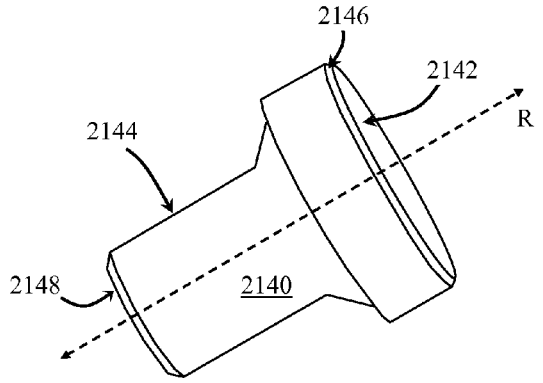
FIG. 21 shows a perspective view of a rolling cutter according to embodiments of the present disclosure.
Figure 22:
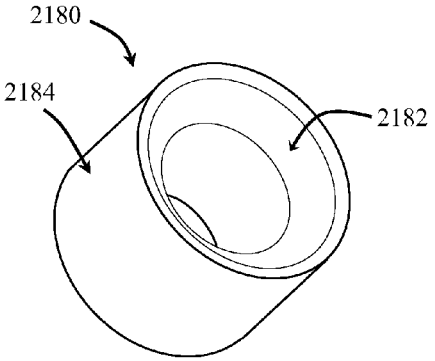
FIG. 22 shows a perspective view of an outer shell according to embodiments of the present disclosure.

Referring now to FIGS. 21-24, embodiments of rolling cutters disclosed herein may also be retained within a cutter pocket by a back retainer, a front retainer and an outer shell. FIG. 21 shows a perspective view of a rolling cutter 2140 according to embodiments of the present disclosure, wherein the rolling cutter 2140 has a cutting face 2142, an outer circumferential surface 2144, a cutting edge 2146 formed at the intersection of the cutting face 2142 and the outer circumferential surface 2144, a back face 2148, and a rotational axis R extending through the length of the rolling cutter 2140. A bevel may be formed at the cutting edge 2146 and/or at the intersection between the back face 2148 and the outer circumferential surface 2144. As shown, the diameter of the outer circumferential surface 2144 proximate the back face 2148 is smaller than the diameter of the outer circumferential surface 2144 proximate the cutting face 2142. Particularly, the diameter of the rolling cutter 2040 may decrease from the cutting face 2142 to the back face 2148. The decrease in diameter may provide a mating portion of the rolling cutter to be inserted into an outer shell. FIG. 22 shows a perspective view of an outer shell 2180, which may be positioned around a portion of a rolling cutter (shown in FIG. 21), such that the rolling cutter may rotate within the outer shell 2180, or alternatively, such that the rolling cutter and the outer shell may rotate together around a back retainer. As shown, the outer shell 2180 may have an inner surface 2182 and an outer surface 2184, wherein the inner surface 2182 may be configured to mate with a portion of the outer circumferential surface of a rolling cutter.

Figure 23:
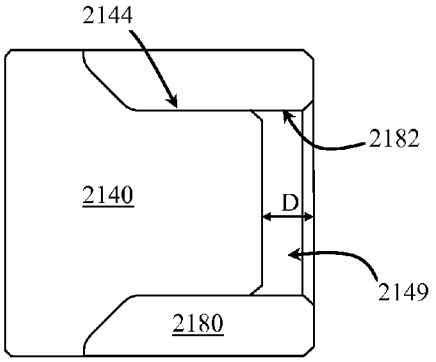
FIGS. 23 and 24 show cross-sectional views of a rolling cutter and outer shell according to embodiments of the present disclosure.
Figure 24:
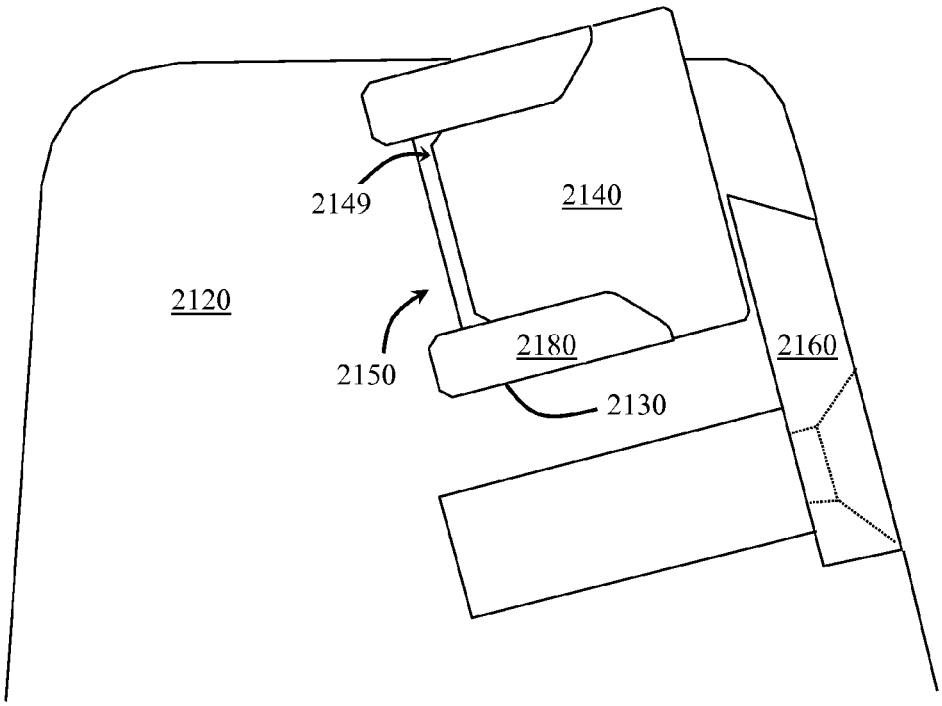
Figure 28:
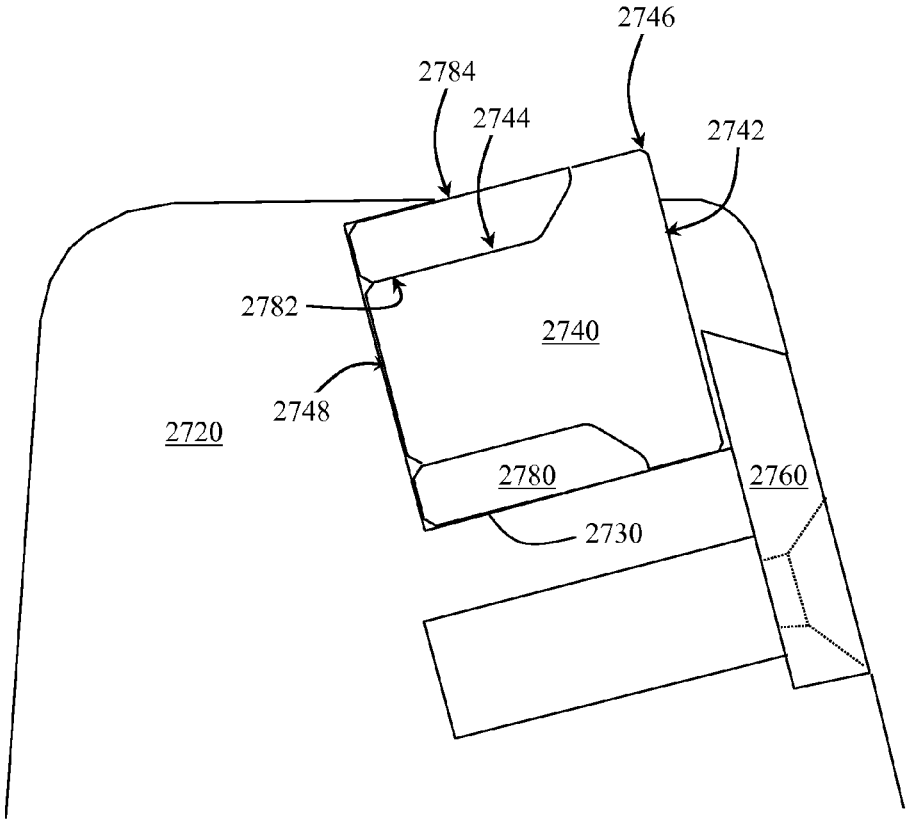
FIG. 28 shows a cross-sectional view of a rolling cutter assembly according to embodiments of the present disclosure.

FIG. 23 shows a cross-sectional view of a rolling cutter 2140 assembled within an outer shell 2180. As shown, the inner surface 2182 may mate with a portion of the outer circumferential surface 2144 of the rolling cutter 2140. Further, the outer shell 2180 may extend a distance D from the back face 2148 of the rolling cutter 2140, such that a hole 2149 is formed adjacent to the back face 2148 and within the inner surface 2182 of the outer shell 2180. However, according to other embodiments (such as shown in FIG. 28), the outer shell may substantially align with the back face of the rolling cutter. FIG. 24 shows a cross-sectional view of the rolling cutter 2140 and the outer shell 2180 assembled in a cutter pocket 2130 formed in a cutting tool blade 2120, wherein the rolling cutter 2140 is retained in the cutter pocket 2130 by the outer shell 2180, a back retainer 2150 and a front retainer 2160. As shown, the back retainer 2150 may be integrally formed with the blade 2120, wherein the back retainer 2150 extends a distance into the hole 2149 formed by the rolling cutter 2140 and the outer shell 2180. The outer shell may be formed of the same material as the rolling cutter or different material than the rolling cutter. For example, an outer shell may be formed of a metal carbide material or a combination of a carbide material and diamond, wherein a portion of the outer shell's inner surface is formed of diamond. According to other embodiments, an outer shell may be formed of other material combinations. Advantageously, some embodiments having an outer shell do not need the outer shell to be brazed or infiltrated to the blade. For example, according to some embodiments, the cutter pocket and the back retainer may be sufficient to retain the outer shell to the cutter pocket.

Figure 27:
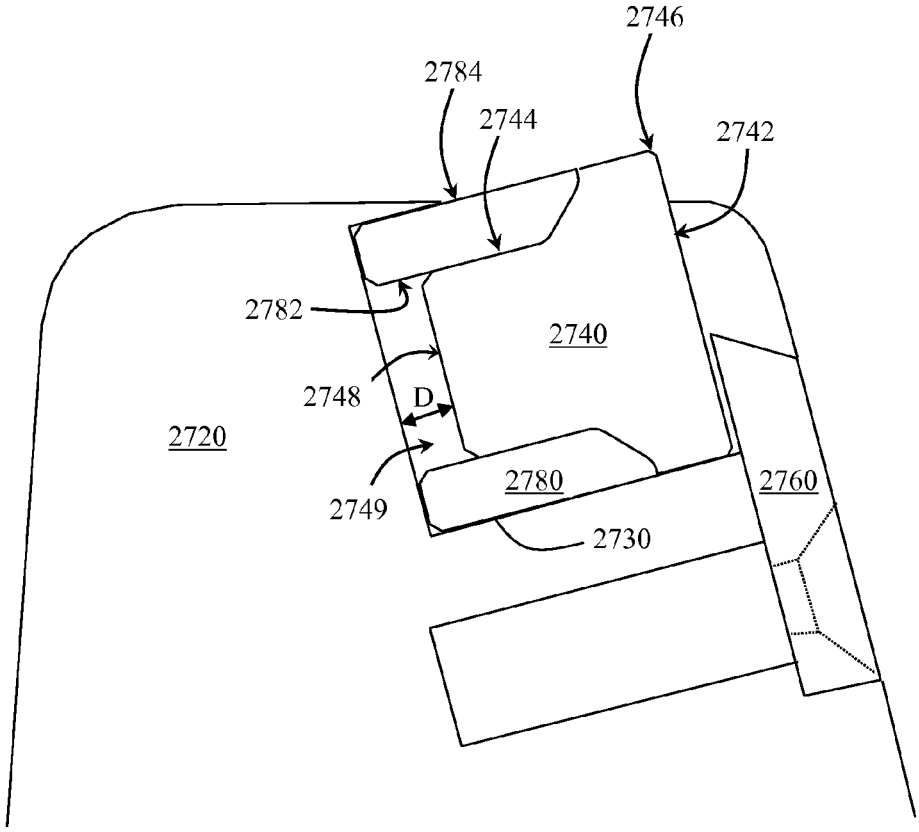
FIG. 27 shows a cross-sectional view of a rolling cutter assembly according to embodiments of the present disclosure.

Referring now to FIGS. 27 and 28, embodiments of rolling cutters disclosed herein may also be retained within a cutter pocket by a front retainer and an outer shell, without a back retention mechanism. FIGS. 27 and 28 show a cross-sectional view of a rolling cutter 2740 and an outer shell 2780 (which may be referred to as a sleeve) assembled in a cutter pocket 2730 formed in a cutting tool blade 2720, wherein the rolling cutter 2740 is retained in the cutter pocket 2730 by the sleeve 2780 and a front retainer 2760. The rolling cutter 2740 has a cutting face 2742, an outer circumferential surface 2744, a cutting edge 2746 formed at the intersection of the cutting face 2742 and the outer circumferential surface 2744, a back face 2748, and a rotational axis extending through the length of the rolling cutter 2740. A bevel may be formed at the cutting edge 2746 and/or at the intersection between the back face 2748 and the outer circumferential surface 2744. As shown, the diameter of the outer circumferential surface 2744 proximate the back face 2748 is smaller than the diameter of the outer circumferential surface 2744 proximate the cutting face 2742. Particularly, the diameter of the rolling cutter 2740 may decrease from the cutting face 2742 to the back face 2748. The decrease in diameter may provide a mating portion of the rolling cutter to be inserted into a sleeve. The sleeve may be positioned around a portion of the rolling cutter, such that the rolling cutter may rotate within the sleeve 2780. The sleeve 2780 may have an inner surface 2782 and an outer surface 2784, wherein the inner surface 2782 may be configured to mate with a portion of the outer circumferential surface of a rolling cutter. Further, the sleeve 2780 may have an outer diameter (measured between the outer surface 2784 of the sleeve) that is substantially equal to the diameter of the rolling cutter 2740 at the cutting face 2742.

As shown in FIG. 27, the sleeve 2780 may extend a distance D from the back face 2748 of the rolling cutter 2740, such that a hole 2749 is formed adjacent to the back face 2748 and within the inner surface 2782 of the sleeve 2780. However, according to other embodiments, such as shown in FIG. 28, an end of the sleeve 2780 may substantially align with the back face 2748 of the rolling cutter 2740. In such embodiments, the back face 2748 and the end of the sleeve 2780 may interface with a back surface of the cutter pocket 2730.

Figure 29:
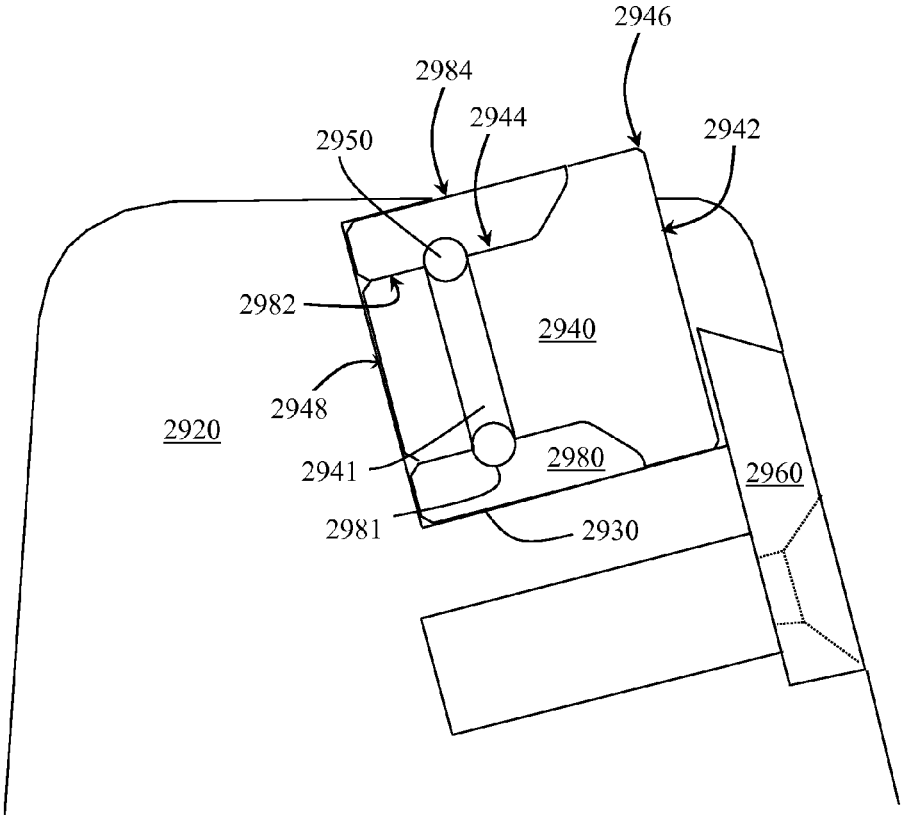
FIG. 29 shows a cross-sectional view of a rolling cutter assembly according to embodiments of the present disclosure.

According to some embodiments of the present disclosure, a rolling cutter may be retained within a cutter pocket by a side retention mechanism, a front retainer and a sleeve. For example, FIG. 29 shows a cross-sectional view of the rolling cutter 2940 and a sleeve 2980 assembled in a cutter pocket 2930 formed in a cutting tool blade 2920, wherein the rolling cutter 2940 is retained in the cutter pocket 2930 by the sleeve 2980, a side retention mechanism 2950 and a front retainer 2960. The rolling cutter 2940 has a cutting face 2942, an outer circumferential surface 2944, a cutting edge 2946 formed at the intersection of the cutting face 2942 and the outer circumferential surface 2944, a back face 2948, and a rotational axis extending through the length of the rolling cutter 2940. The sleeve 2980 has an inner surface 2982 and an outer surface 2984. The side retention mechanism 2950 is disposed between the sleeve 2980 and the rolling cutter 2940 to axially retain the rolling cutter within the sleeve. As shown, the side retention mechanism 2950 may include at least one ball 2951 disposed between a circumferential groove 2941 formed around the outer circumferential surface 2944 of the rolling cutter 2940 and a corresponding groove 2981 formed around the inner surface 2982 of the sleeve 2980. However, other forms of side retention mechanisms may be used between the sleeve and rolling cutter side walls to axially retain the rolling cutter within the sleeve. For example, a protrusion may be formed around the outer circumferential surface of the rolling cutter and a corresponding groove may be formed around the inner surface of the sleeve and/or a groove may be formed around the outer circumferential surface of the rolling cutter and a corresponding protrusion may be formed around the inner surface of the sleeve. In some embodiments, side retention mechanisms may be integrally formed with the rolling cutter and/or the sleeve. In other embodiments, side retention mechanisms may be separate components from the sleeve and/or rolling cutter.

In other embodiments, a rolling cutter may be retained within a cutter pocket without using a front retainer. In such embodiments, a rolling cutter may be retained within a cutter pocket by at least two of a side retention mechanism, a sleeve, and a back retention mechanism. For example, according to some embodiments, a rolling cutter may be retained within a cutter pocket using a combination of a side retention mechanism and a sleeve. The side retention mechanism, such as those described above, may retain the rolling cutter axially within the sleeve, and the sleeve may retain the rolling cutter from being radially dislodged from the cutter pocket. In some embodiments, a rolling cutter may be retained within a cutter pocket using a combination of a side retention mechanism, such as described above, and a back retention mechanism, such as one described above. The side retention mechanism may retain the rolling cutter axially within the sleeve, and the back retention mechanism may retain the rolling cutter from being radially dislodged from the cutter pocket.

Methods of manufacturing embodiments according to the present disclosure may include, for example, forming a bit body having a threaded pin end and a cutting end, wherein at least one blade is formed on the cutting end, and wherein the blade has a plurality of cutter pockets formed therein. A rolling cutter may then be placed into at least one of the plurality of cutter pockets, adjacent to a back retainer. An attachment end of a front retainer may be attached to a portion of the blade, such that a retention end of the front retainer covers a portion of a cutting face of the rolling cutter. The back retainer may be integrally formed with the bit body and extends from a back surface of the at least one cutter pocket. Alternatively, the back retainer may be a separate component from the blade, disposed within a cutter pocket hole in a back surface of the at least one cutter pocket. Further, the front retainer may be attached to a blade by inserting the attachment end of the front retainer into a cavity formed in the blade. According to some embodiments, the cavity may be threaded, wherein the step of inserting the attachment end includes screwing the attachment end into the threaded cavity.

Advantageously, by using a back retainer and front retainer according to the present disclosure, a rolling cutter may be retained within a cutter pocket having a decreased amount of cutter pocket coverage, which may also provide better cleaning of the cutter pocket during drilling. For example, embodiments having decreased cutter pocket coverage may include cutter pockets that extend less than 180 degrees and greater than 120 degrees around a portion of the outer circumferential surface of a rolling cutter. Decreased cutter pocket coverage may allow for a wider range of rolling cutter sizes, such as rolling cutters with larger diameters and/or shorter lengths than conventional cutters, and may match the amount of cutter exposure of standard fixed cutters, including ones with low back rake angles. Further, by using a back retainer and front retainer according to the present disclosure to retain a rolling cutter within a cutter pocket rather than the conventional brazing process, high processing temperatures may be avoided. Thus, harmful thermal exposure to embodiments having a polycrystalline diamond layer or thermally stable polycrystalline diamond layer may be reduced.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A drill bit, comprising:

a bit body;

a plurality of blades extending radially from the bit body, wherein each blade comprises a leading face and a trailing face;

a plurality of cutter pockets disposed on the plurality of blades;

at least one rolling cutter, wherein each rolling cutter is disposed in one of the cutter pockets, and wherein each rolling cutter comprises a cutting face, a cutting edge, an outer circumferential surface, and a back face;

a back retainer disposed adjacent to the back face, wherein the back retainer protrudes partially into the rolling cutter along a rotational axis of the rolling cutter; and a front retainer disposed adjacent to the at least one rolling cutter on the leading face of the blade, wherein each front retainer comprises:

a retention end, wherein the retention end is positioned adjacent to a portion of the cutting face of each rolling cutter; and an attachment end, wherein the attachment end is attached to a leading face of the blade adjacent to the one of the cutter pockets.

2. The drill bit of claim 1, wherein the back retainer is a ball.

3. The drill bit of claim 1, wherein the back retainer is a pin.

4. The drill bit of claim 1, wherein the back retainer is integral with the bit body.

5. The drill bit of claim 1, further comprising:

a screw; and at least one threaded cavity formed within the leading face of the blade below each cutter pocket, wherein the screw is inserted through a hole in the attachment end of the front retainer and into the threaded cavity in the blade, thereby attaching the attachment end to a portion of the leading face of the blade.

6. The drill bit of claim 5, wherein the threaded cavity comprises a threaded nut brazed within a cavity.

7. The drill bit of claim 1, wherein the back retainer extends into the rolling cutter a distance less than or equal to an entire length of the rolling cutter.

8. The drill bit of claim 1, wherein the rolling cutter further comprises a polycrystalline diamond table and wherein the polycrystalline diamond table forms the cutting face.

9. The drill bit of claim 1, wherein the back face of the rolling cutter has a conical shape.

10. The drill bit of claim 1, wherein the front retainer comprises carbide.

11. The drill bit of claim 1, wherein the back retainer comprises diamond.

12. The drill bit of claim 1, further comprising a disc spring positioned between the cutter pocket and the back face of the rolling cutter.

13. The drill bit of claim 1, further comprising a sleeve disposed around the rolling cutter and around the back retainer.

14. The drill bit of claim 1, wherein the attachment end of the front retainer forms a portion of the cutter pocket.

15. The drill bit of claim 1, wherein the cutter pocket extends less than 180 degrees and greater than 120 degrees around the circumference of at least a portion of the at least one rolling cutter.

16. A method of manufacturing a drill bit, comprising:

forming a bit body comprising a threaded pin end and a cutting end, wherein at least one blade having a blade face is formed on the cutting end, and wherein the blade has a plurality of cutter pockets formed therein;

placing a rolling cutter into at least one of the plurality of cutter pockets, adjacent to a back retainer, wherein the rolling cutter comprises a substrate and a cutting face; and attaching an attachment end of a front retainer to a portion of the blade face adjacent to the at least one of the plurality of cutter pockets, such that a retention end of the front retainer covers a portion of the cutting face.

17. The method of claim 16, wherein the back retainer is integral with the bit body and extends from a back surface of the at least one cutter pocket.

18. The method of claim 16, wherein the back retainer is disposed within a cutter pocket hole in a back surface of the at least one cutter pocket.

19. The method of claim 16, wherein the blade has at least one cavity formed therein and wherein the step of attaching comprises:

inserting the attachment end of the front retainer into the cavity.

20. The method of claim 19, wherein the at least one cavity is threaded, and wherein the step of inserting the attachment end comprises screwing the attachment end into the threaded cavity.

21. The method of claim 16, further comprising disposing a sleeve around the rolling cutter and the back retainer.

22. A drill bit, comprising:

a bit body;

a plurality of blades extending radially from the bit body, wherein each blade comprises a leading face and a trailing face;

a plurality of cutter pockets disposed on the plurality of blades;

at least one rolling cutter partially surrounded by a sleeve, wherein each rolling cutter and sleeve are disposed in one of the cutter pockets; and a front retainer disposed adjacent to the at least one rolling cutter on the leading face of the blade and a distance apart from the sleeve, wherein each front retainer comprises:

a retention end, wherein the retention end is positioned adjacent to a portion of a cutting face of each rolling cutter; and an attachment end, wherein the attachment end is attached to a portion of the leading face of the blade adjacent to the one of the cutter pockets.

23. The drill bit of claim 22, wherein the sleeve has an outer diameter substantially equal to a diameter of the cutting face of the rolling cutter.

24. The drill bit of claim 22, further comprising a side retention mechanism between the sleeve and the rolling cutter.

25. The drill bit of claim 24, wherein the side retention mechanism comprises at least one ball disposed between a circumferential groove formed around the rolling cutter and a corresponding groove formed around an inner wall of the sleeve.

26. The drill bit of claim 24, wherein the side retention mechanism is integrally formed with the sleeve.

27. The drill bit of claim 22, wherein a back face of the rolling cutter is substantially aligned with an end surface of the sleeve.

* * * * *